US008523324B2

(12) United States Patent
Yamaguchi et al.

(10) Patent No.: US 8,523,324 B2
(45) Date of Patent: Sep. 3, 2013

(54) LIQUID DISCHARGE HEAD SUBSTRATE AND HEAD UNIT

(75) Inventors: Takaaki Yamaguchi, Yokohama (JP); Yoshiyuki Imanaka, Kawasaki (JP); Koichi Omata, Kawasaki (JP); Toshio Negishi, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 350 days.

(21) Appl. No.: 13/043,893

(22) Filed: Mar. 9, 2011

(65) Prior Publication Data

US 2011/0221823 A1 Sep. 15, 2011

(30) Foreign Application Priority Data

Mar. 11, 2010 (JP) ..... 2010-054719

(51) Int. Cl.
*B41J 2/14* (2006.01)
*B41J 2/16* (2006.01)

(52) U.S. Cl.
USPC ..... 347/50; 347/40; 347/44

(58) Field of Classification Search
USPC ..... 347/20, 40, 42–44, 49–50, 58, 86
See application file for complete search history.

(56) References Cited

U.S. PATENT DOCUMENTS 6,945,622 B2 9/2005 Sakurai
7,868,957 B2 * 1/2011 Yamazaki et al. ..... 349/43

FOREIGN PATENT DOCUMENTS

CN 1810510 A 8/2006
CN 1907710 A 2/2007
JP 06-125041 A 5/1994
JP 08-281955 A 10/1996

* cited by examiner

*Primary Examiner* — Thinh Nguyen
(74) *Attorney, Agent, or Firm* — Canon USA Inc. IP Division

(57) ABSTRACT

A liquid discharge head substrate includes an external terminal, a diode, a first conductive layer, a second conductive layer, and a third conductive layer. The external terminal is configured to connect to an external. The first conductive layer is connected to the external terminal for causing an input current to flow from the external terminal, and the diode includes an anode and a cathode. The second conductive layer is connected to the first conductive layer and one electrode of the anode and cathode, and causes a surge current generated when a surge voltage is applied from the external terminal, to flow from the first conductive layer to the one electrode. The third conductive layer is connected to the other electrode of the anode and the cathode and passes the surge current flowing from the one electrode to the other electrode. The first conductive layer includes a part laminating with the second conductive layer sandwiching an insulation layer, and does not include a part laminating with the third conductive layer.

8 Claims, 8 Drawing Sheets

LIQUID DISCHARGE HEAD SUBSTRATE AND HEAD UNIT

BACKGROUND OF THE INVENTION

1. Field of the Invention

The present invention relates to a liquid discharge head substrate and a head unit.

2. Description of the Related Art

A contact pad (a connection terminal) works as an electric contact between a recording apparatus and a head unit capable of being mounted to the recoding apparatus. The contact pad can be touched by a user who has not carried out a static elimination processing when the user attaches/detaches the liquid discharge head. In such a case, a surge voltage by a static electricity discharge enters internal elements of a liquid discharge head from a terminal and can break the internal elements, so that the liquid discharge head is required to have a countermeasure for the static electricity discharge. U.S. Pat. No. 6,945,622 discusses a configuration in which a protection diode is provided as a static electricity protection circuit in an input terminal provided on a liquid discharge head substrate.

The liquid discharge head substrate mounted in the liquid discharge head is produced using semiconductor production processing. To cut down on the cost by increasing numbers of products which can be produced from one piece of wafer, downsizing of the head is required, so that reduction of an area for wiring is advancing. Therefore, in the protection diode, the reducing an area of the liquid discharge head has advanced by providing the wiring with a laminated structure.

An example of configurations of a circuit of a liquid discharge head substrate and a wiring layer is illustrated in FIGS. 8A, 8B, 8C, and 8D. The liquid discharge head has a configuration in which a protection diode is provided in an external terminal as a static electricity protection circuit. FIG. 8A illustrates a block diagram of the protection diode. The external terminal 101 electrically connecting to an outside is provided at an end of a first wiring 22 connecting to an inverter circuit 301. The first wiring 22 is further connected to a second wiring 55 via a first protection diode 103 and a third wiring 66 via a second protection diode 104.

FIG. 8B is a top view illustrating an example in which the protection diode in the X part illustrated in FIG. 8A is downsized by laminating a plurality of wirings and provided. In the first wiring 22, a first lower conductive layer 118 and a first upper conductive layer 102 are laminated and connected via a through hole 1001 provided in the second insulation layer 115 made of SiO. The first lower conductive layer 118 and the upper conductive layer 102 are made of a conductive material such as aluminum. In this structure, the first lower conductive layer 118 has an equal potential to the first upper conductive layer 102. A second lower conductive layer 105, which forms the second wiring 55, connects to a potential connecting to a large capacity power supply (the potential can be an almost same potential used in a signal input from the terminal 101: hereinafter referred to as a power supply potential). A third lower conductive layer 106, which forms the third wiring 66, is connected to a substrate potential. Further, on a lower side of the second lower conductive layer 105 and the third lower conductive layer 106, a first insulation layer 114 and a thermally-oxidized layer 113 are provided. The first insulation layer 114 is made of boron phosphorus silicon glass (BPSG), and used as an insulation layer and a heat accumulation layer. The thermally-oxidized layer 113 is formed by oxidizing a substrate 109 made of silicon. The second lower conductive layer 105 and the third lower conductive layer 106 are connected to the first protection diode 103 and the second protection diode 104, which are formed in the silicon substrate, via a plurality of through holes 1003 provided in the first insulation layer 114.

FIG. 8C is a cross-sectional view of a line C-C' of the first protection diode 103 in FIG. 8B, which is connected to the power supply potential. In a p-type substrate 109, a n-type well region 110, a n-type (n+) impurity diffusion region 111, p-type (p+) impurity diffusion region 112, and the thermally-oxidized layer 113 are formed. The first insulation layer 114 made of BPSG is formed on the above described layers. The through hole 1003 is formed in the thermally-oxidized layer 113 and the first insulation layer 114. The impurity diffusion region 112 and the first lower conductive layer 118 are connected to each other, and the impurity diffusion region 111 and the second lower conductive layer 105 are connected to each other respectively, so that the first protection diode 103 is formed.

FIG. 8D is a cross sectional view of a line D-D' of the second protection diode 104 in FIG. 8B, which is connected to the substrate potential. In a p-type substrate 109, a p-type well region 120, a n-type (+n) impurity diffusion region 111, a p-type (+p) impurity diffusion region 112, and the thermally-oxidized layer 113 are formed. The first insulation layer 114 made of BPSG is formed on the above described layers. The through hole 1003 is formed in the thermally-oxidized layer 113 and the first insulation layer 114. The impurity diffusion region 112 and the third lower conductive layer 106 are connected to each other, and the impurity diffusion region 111 and the first lower conductive layer 118 are connected to each other respectively, so that the second protection diode 104 is formed.

With this configuration, when a surge voltage caused by static electricity is applied from the contact pad of the head unit, a surge current flows in the terminal of the liquid discharge head from the contact pad. Further, the surge current flows from the terminal to the upper conductive layer 102, and flows from the upper conductive layer 102 to the second lower conductive layer 105 through the first protection diode 103 or to the third lower conductive layer 106 through the second protection diode 104. With the configuration, the surge current caused by the static electricity can be prevented from flowing in an inside of the inverter circuit 301, so that dielectric breakdown of a switching element can be prevented.

In this case, in the protection diode, it is required that insulation between the upper conductive layer 102, and the second lower conductive layer 105 and the third lower conductive layer 106 is provided by the second insulation layer 115. More specifically, in an area Y of the second insulation layer 115, the insulation between the upper conductive layer 102 and the second lower conductive layer 105, and the insulation between the upper conductive layer 102 and the third lower conductive layer 106 need to be secured. The upper conductive layer 102 has an equal potential to the surge voltage, the second lower conductive layer 105 has the power supply potential and the third lower conductive layer 106 has the substrate potential.

However, since the second insulation layer 115 is sandwiched between the upper conductive layer 102, and the second lower conductive layer 105 or the third lower conductive layer 106, which have different potentials from each other, dielectric breakdown can arise. Particularly, in a step part (a concavo-convex part) of the through hole 1003 of the lower conductive layer, that is, a thickness of the second insulation layer 115 in the end part of the first insulation layer 114 is thinner than the second insulation layer 115 in a flat part. Thus, the dielectric breakdown of the second insulation layer 115 in the area Y can occur depending on a size of the surge voltage.

Particularly, in the liquid discharge head, which discharges a liquid utilizing heat generated by an energy generation element, there is a close relationship between a thickness of the layers of the thermally-oxidized layer 113, the first insulation layer 114, and the second insulation layer 115, and discharge characteristics of the liquid discharge head, such as a heat accumulation property and heat irradiation property. Thus, it is actually difficult to make the second insulation layer 115 thick enough to prevent the dielectric breakdown, when a compatibility with the discharge characteristics of liquid discharge head is considered.

SUMMARY OF THE INVENTION

The present invention provides a liquid discharge head substrate with high reliability, in which a dielectric breakdown in an inside of an electric circuit is suppressed and a breakdown of the electric circuit caused by a static electricity discharge is suppressed.

According to an aspect of the present invention, a liquid discharge head substrate includes an external terminal, a diode, a first conductive layer, a second conductive layer, and a third conductive layer. The external terminal is configured to connect to an external. The first conductive layer is connected to the external terminal for causing a current input from the external terminal to flow, and the diode includes a cathode and an anode. The second conductive layer is connected to the first conductive layer and one electrode of the cathode and the anode, and causes a surge current generated when a surge voltage is applied from the external terminal, to flow from the first conductive layer to the one electrode. The third conductive layer is connected to another electrode of the cathode and the anode, and passes the surge current which flows from the one electrode to the other electrode. The first conductive layer includes a part laminated with the second conductive layer sandwiching an insulation layer and does not include apart laminated with the third conductive layer.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

The liquid discharge head can be equipped in an apparatus such as a printer, a copying machine, a facsimile having a communication system, and a word processor having a printing unit, and further in an industrial recording apparatus complexly combined with various kinds of a processing apparatus. Using the liquid discharge head, the apparatus can record an image on various recording mediums, such as a paper, a thread, a fiber, a cloth, leather, a metal, plastics, a glass, a wood, and ceramics.

The meaning of the word "recording" used in the present specification not only applies to images having a denotation such as characters and figures, to the medium to be recorded but also applying images having no denotation such as patterns.

Further, the word "ink" should be widely interpreted and means a liquid which is applied to the recording medium and used for forming images, designs, and patterns, processing the recording medium, or a liquid which is subjected to a treatment of the ink or the recording medium. The treatment of the ink or the recording medium refers to, for example, an improvement of fixing by solidification or insolubilization of color materials in the ink applied to the recording medium, an improvement of a recoding quality or a coloring property, and an improvement of durability of recorded image.

Figure 1A:
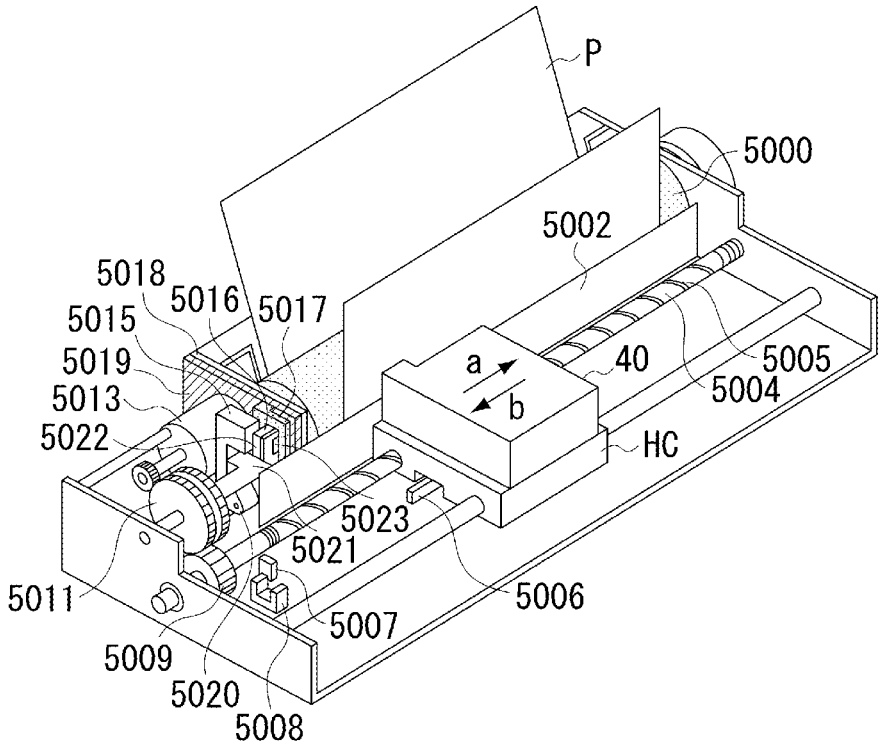
FIGS. 1A and 1B illustrate a perspective view of a liquid discharge apparatus and a liquid discharge head unit which can use an exemplary embodiment of the present invention.

FIG. 1A is a schematic view illustrating an example of a liquid discharge apparatus which can be mounted with the liquid discharge head according to the exemplary embodiments of the present invention. As illustrated in FIG. 1A, a lead screw 5004 rotates coordinating with a positive/negative rotation of a drive motor 5013 via driving force transmission gears 5011 and 5009. A carriage HC can be mounted with the head unit and has a pin engaging with a spiral groove 5005 of the lead screw 5004. A head unit can make a reciprocating motion in directions of arrows a and b by rotating the lead screw 5004.

A paper pressing plate 5002 presses a recording sheet P to a platen 5000 over a moving direction of the carriage HC. Photo-sensors 5007 and 5008 are home position detection elements for detecting a lever 5006 of the carriage HC in a detection area and switching a rotation direction of the motor 5013. A cap 5022 air-tightly covering a front face of the head unit 40 is supported by a supporting member 5016. Further, a suction member 5015 for sucking an inside of the cap 5022 can perform suction recovery of the head unit 40 via an opening 5023 in the cap 5022. A cleaning blade 5017 and a member 5019 which moves the cleaning blade 5017 in forward/backward direction are supported by a supporting plate 5018 of an apparatus main body.

Figure 1B:
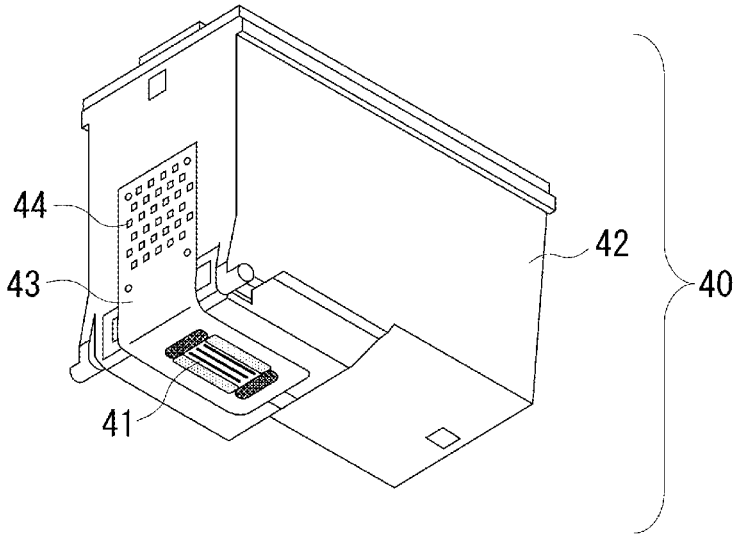

FIG. 1B is a perspective view of the head unit 40 including the liquid discharge head 41 detachable to a liquid recording apparatus (a discharge apparatus). The liquid discharge head 41 (hereinafter referred to as a head) connects to the liquid recording apparatus by a flexible film wiring board 43 connecting to a connection terminal 7 and electrically connects to a contact pad 44 having electric continuity. Further, the head 41 is supported by the head unit 40 by being bonded to a supporting substrate. In this exemplary embodiment, as the head unit 40, the head 41 integrated with an ink tank 42 is illustrated, but a separate-type which can separate the ink tank can be used.

By connecting the contact pad 44 to the liquid recording apparatus, a data signal and a voltage for discharging a liquid, are supplied from the liquid recording apparatus to the head 41. Since such a contact pad 44 is often provided at an outside face of the head unit 40, a user can touch the contact pad 44 when the user attaches/detaches the head unit 40 to/from the liquid recording apparatus, so that there is a possibility to generate a surge.

Figure 2A:
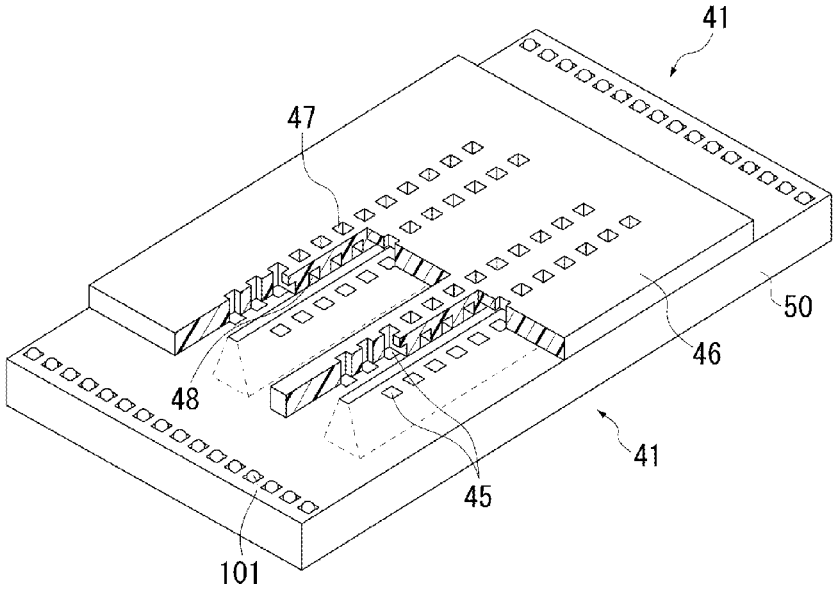
FIGS. 2A and 2B is a perspective view and a cross sectional view of the liquid discharge head which can use the exemplary embodiment of the present invention.

FIG. 2A is a perspective view of the liquid discharge head 41 which can use the exemplary embodiment of the present invention. The liquid discharge head 41 according to the exemplary embodiment of the present invention includes a liquid discharge head substrate 50 including an energy generating element 45 and a flow path member 46 contacting the liquid discharge head substrate 50. In the liquid discharge head substrate 50, a supply port 49 for supplying a liquid is provided, penetrating the liquid discharge head substrate 50, and a plurality of energy generating elements 45 are arranged at the both side of the supply port 49 along the supply port 49. Further, at an end part of the liquid discharge head substrate 50, a plurality of terminals 101 for supplying electric signals and electric power, which are used for driving the energy generating elements 45, is provided.

The flow path member 46 includes the discharge ports 47, which can discharge a liquid using the energy generated by the energy generating element 45, at a position opposite to each energy generating element 45. The flow path member 46 further includes a concave portion 48*a*, which configures a flow path 48 communicating the discharge port 47 with supply port 49, and contacts the liquid discharge head substrate 50.

Figure 3A:
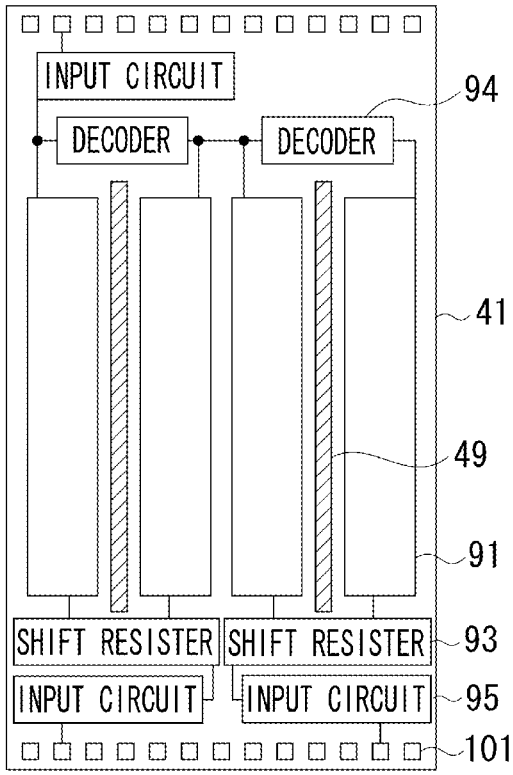
FIGS. 3A and 3B is an top schematic view of the liquid discharge head which can use the exemplary embodiment of the present invention.

FIG. 3A illustrates a layout of an electric circuit of the liquid discharge head 41. In areas 91 provided at both sides of supply port 49, arrays of energy generating elements 45, a switching element 452 for drive-controlling (control ON/OFF) of the energy generating element 45, and an AND circuit are provided. In the AND circuit including metal-oxide-semiconductor (MOS) transistors (450 and 451), a signal from a shift resister 93 and a decoder 94 is input. The shift resistor 93 temporally stores a recording data signal and the decoder 94 sends a block selection signal for selecting a block of the energy generating elements 45. The AND circuit implements logical sum operation of the recording data signal and the block selection signal, and outputs a signal with which the switching element 452 drive-controls the energy generating elements 45. In the present exemplary embodiments, the recording data signal used for drive-controlling the energy generating elements 45, the block selection signal, a clock signal, a latch signal, and a heat-enable signal are referred to as a logic signal.

The logic signal input from the terminal 101 (an external terminal) is sent to input circuit 95 which is used as a buffer circuit and includes a plurality of inverter circuits, and further sent to the shift resistor 93 and the decoder 94. As an input voltage used for inputting the logic signal, comparatively low voltage of about around 3.3 V is used.

When the surge voltage of a high voltage caused by a static electricity discharge comes in from the terminal 101 inputting such a logic signal, there is a high possibility of dielectric breakdown of the insulation layer. Therefore, to prevent the internal circuit from the dielectric breakdown by the static electricity discharge, a static electricity protection circuit (a protection diode), which is a feature part of the exemplary embodiment of the present invention, is provided.

In addition, it is preferable to provide the static electricity protection circuit because if static electric discharge occurs there is a high possibility of generating the dielectric breakdown in not only in a terminal for the logic signal but also in a terminal for other functional elements which are driven by a relatively low voltage. The terminal for other functional elements is, for example, a terminal of a thermal sensor or a detection terminal.

Figure 2B:
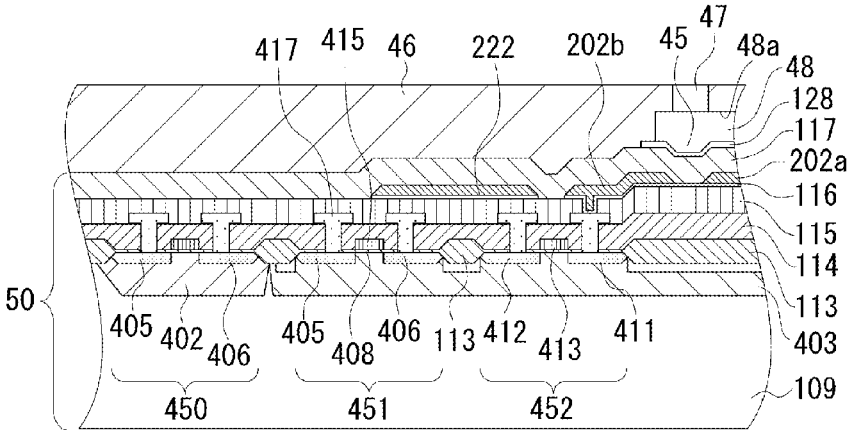

FIG. 2B illustrates an example of a cross-sectional view of the area 91, in which the energy generating element 45 and the switching element 452 are provided, in such a liquid discharge head 41. A silicon substrate 109 containing a p-type conductive material includes a thermally-oxidized layer 113 which is formed by thermally oxidizing a part of the substrate 109. Further, a first insulation layer 114, lower conductive layer (a first conductive layer), a second insulation layer 115, a heating resistance layer 116, an upper conductive layer (a second conductive layer), and protection layer 117 are laminated and provided in this order. As the lower conductive layer and the upper conductive layer, a conductive material, such as aluminum, can be used. The first insulation layer 114 can be formed using an insulation material containing silicon, such as BPSG (silicon oxide doped by phosphorous and born). The second insulation layer 115 can be formed using an insulation material containing silicon, such as silicon oxide (SiO) and silicon nitride (SiN). Further, the heating resistance layer 116 can be formed using a high electric resistance material, such as TaSiN.

A part of the upper conductive layer is partially removed on the heating resistance layer 116, and used as one pair of discrete wirings 202. The one pair of the discrete wirings 202 and heating resistance layer 116 are covered with the protection layer 117 and protected from a liquid. A gap part between the one pair of the discrete wirings 202 is used as the energy generating element 45 for discharging the liquid. One of the discrete wirings 202 is used as an electrode 202*a* supplying the power supply potential and the other one is used as an electrode 202*b* connecting to a substrate potential. By applying electrical current to the one pair of the discrete wirings 202, the energy generating element 45 generates heat energy, and causes the liquid film boiling and generate bubbles. A pressure of these bubbles pushes the liquid out of the discharge port 47, so that the recording operation is performed. Since cavitation can generate and give a damage to the protection layer 117 when the debubbling occurs, an anti-cavitation layer 128 made of Ta can be formed on the protection layer 117. Further, in the liquid discharge head 41, the thermally-oxidized layer 113, the first insulation layer 114, and the second insulation layer 115 are provided on the substrate 109, and heat accumulation properties and heat radiation properties, more specifically, thicknesses of the layers, are adjusted so as to enable a stable discharging operation.

Then, a cross-sectional structure part provided by the switching element 452 including a N-MOS transistor 451, a P-MOS transistor 450 configuring the AND circuit and the N-MOS transistor 451 will be described. In an inside of the substrate 109, n-type well region 402 and p-type well region 403 are formed by doping an impurity and diffusion, using a conventional ion implantation technology. The P-MOS transistor 450 and the N-MOS transistor 451 are respectively configured with a gate insulation layer 408, a gate wiring 415 made of polycrystalline silicon (poly-Si), a source region 405 or a drain region 406 which are doped by n+ type impurity or p+ type impurity. Further, the N-MOS transistor which forms the switching element 452 is configured by providing a drain region 411, a source region 412, and a gate wiring 413 on the p-type well region 403. A thermally-oxidized film separation region 453 made of the thermally-oxidized layer 113 is formed between these adjoining MOS transistors so that element separation is performed.

A wiring 417 provided in apart of the lower conductive layer (the first conductive layer) connects to the MOS transistor via a through hole (a penetration part) provided in the first insulation layer 114. Further, the wiring 417 connects to the discrete wiring 202 via a through hole (a penetration part) provided in the second insulation layer 115. The discrete wiring 202 is positioned in an upper side of the second insulation layer 115 and is apart of the upper conductive layer.

Figure 3B:
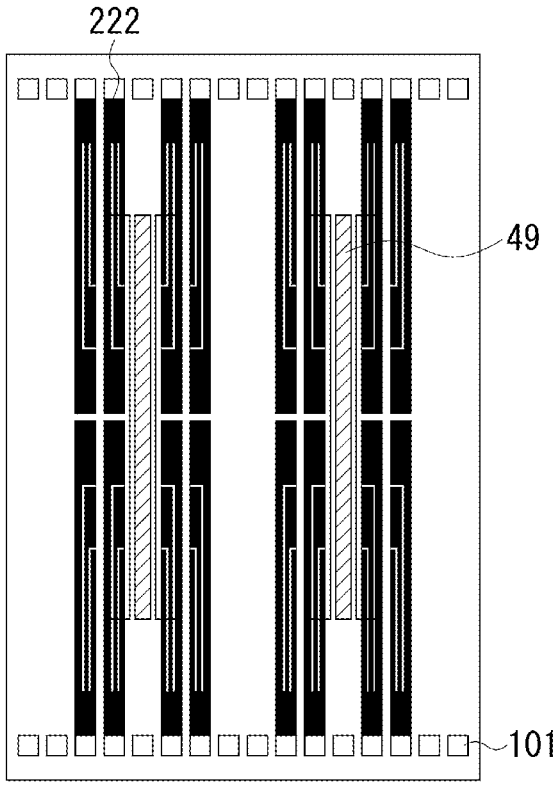

In a direction perpendicular to a surface of the substrate 109, in FIG. 3B, a common wiring 222 is provided in an upper side of the second insulation layer 115 of the domain 91. The common wiring 222 connects a terminal 101 to the discrete wirings 202, which connects to a plurality of the energy generating elements 45, and connects to the substrate potential, and supplies the power supply potential. As described above, the lower conductive layer and the upper conductive layer configuring the discrete wiring 202 and the common wiring 222 are laminated in the direction perpendicular to the surface of the substrate 109, so that the area of the liquid discharge head substrate is reduced.

With regard to a configuration and an operation of the static electricity protection circuit used in the aforementioned liquid discharge head substrate, a first exemplary embodiment will be described below. In the first exemplary embodiment, an example of a case in which the power supply potential is higher than the substrate potential will be described.

Figure 4A:
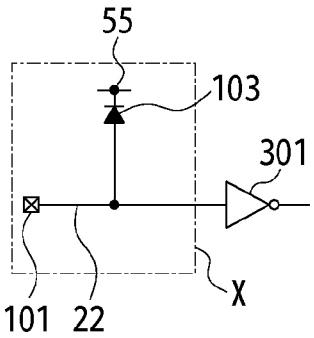
FIGS. 4A through 4C illustrate a static electricity protection element.

FIG. 4A is a block diagram illustrating a liquid discharge head in which a first protection diode 103 is provided. The first protection diode 103 can pass a surge current, which is generated when a static electricity surge is applied, to a wiring connecting to a potential connected to a large capacity power supply (hereinafter referred to as a power supply potential). In the first exemplary embodiment, the power supply potential is connected to a power supply which can supply an almost the same potential as the potential used for a signal input from the terminal 101, and can use, for example, the potential of 3.3 V. An anode (one of the electrodes) of the first protection diode 103 is connected to the first wiring 22, connecting the terminal 101 (an external terminal) which electrically connects with an outside, to an inverter circuit 301 provided in the input circuit 95. A cathode (the other electrode) of the first protection diode 103 is connected to the second wiring 55 connecting to the power supply potential including the lower conductive layer.

With this configuration, even when the surge by the static electricity discharge having a potential higher than the power supply potential is applied from the terminal 101, the surge current flows from the terminal 101 to the second wiring 55 via the first protection diode 103 (from the anode to the cathode). Therefore, the inverter circuit 301 can be prevented from being broken.

Figure 4B:
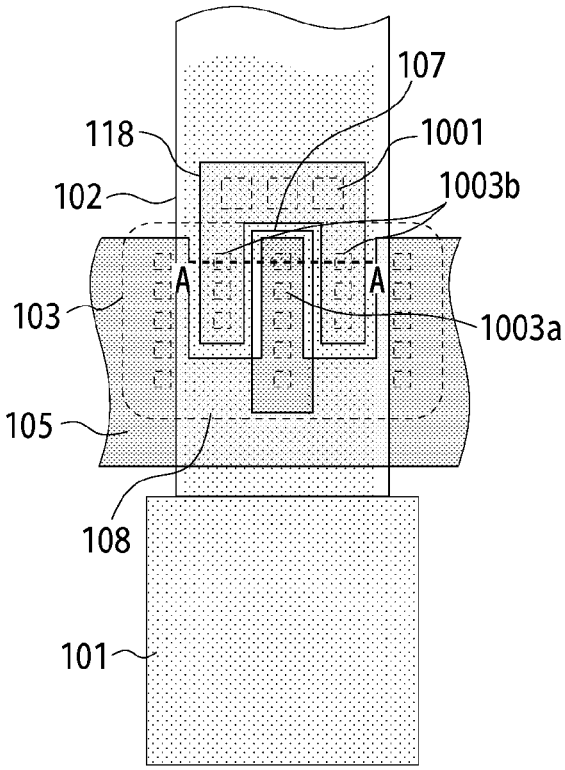
Figure 4C:
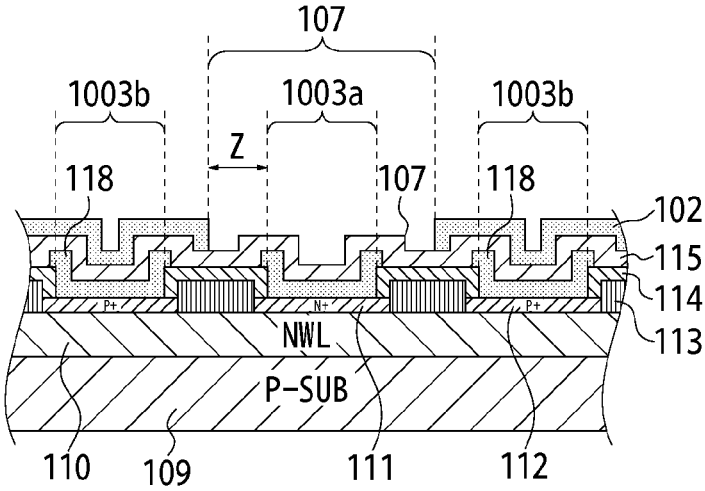

FIG. 4B is atop view of an X part in FIG. 4A. FIG. 4C illustrates a cross-sectional view of an A-A line in FIG. 4B. On the substrate 109, the lower conductive layer and the upper conductive layer are laminated and provided sandwiching the second insulation layer 115. In an inside of the surface of the p-type silicon substrate 109, the first protection diode 103 including n-type well region 110, a n-type (n+) impurity diffusion region 111, and a p-type (p+) impurity diffusion region 112 is provided. Further, the thermally-oxidized layer 113 is provided between the n-type (n+) impurity diffusion region 111 and the p-type (p+) impurity diffusion region 112, and performs an element separation of the n-type (n+) impurity diffusion region 111 and the p-type (p+) impurity diffusion region 112. Further, the first insulation layer 114 made of BPSG is formed on the thermally-oxidized layer 113.

In the first insulation layer 114, a first through hole 1003*b* (a first penetration part) is provided and the p+ impurity diffusion region 112 and the first lower conductive layer 118 (the second conductive layer), which is one part of the lower conductive layer, are connected to each other. Further, in a second through hole 103*a* (a second penetration part) in the first insulation layer 114, the n+ impurity diffusion region 111 and the second lower conductive layer 105 (the third conductive layer), which is another part of the lower conductive layer, are connected. In this structure, one pair of the lower conductive layers (the second conductive layer and the third conductive layer) are provided so as to respectively connect to the impurity regions of the first protection diode.

An upper conductive layer 102 (the first conductive layer) is connected to the terminal 101 electrically connecting to an external. In the second insulation layer 115 made of SiO, a through hole 1001 is provided. The first lower conductive layer 118 and the upper conductive layer 102 are connected via the through hole 1001 so as to be the same potential, and the first wiring 22 is provided. The second lower conductive layer 105 which forms a second wiring 55 is connected to the power supply potential.

In the area in which the through hole 1003 is provided, as illustrated in FIG. 4C, since the through hole 1003 is provided in the thermally-oxidized layer 113 and the first insulation layer 114, a step height of the second insulation layer 115 is large in comparison with the other areas, so that dielectric breakdown can be generated when a high potential difference is applied.

In this configuration, the first lower conductive layer 118 is connected to the upper conductive layer 102 by a through hole 1001 provided in the second insulation layer 115, and the upper conductive layer 102 and the first lower conductive layer 118 are at the same potential even when the surge is applied. Therefore, although the first lower conductive layer 118 (the second conductive layer) and the upper conductive layer 102 (the first conductive layer) are laminated sandwiching the second insulation layer 115, there is low possibility of the dielectric breakdown of the second insulation layer 115. On the other hand, in the second through hole 1003*a*, if the upper conductive layer 102 is provided on the second insulation layer 115, a large potential difference is generated between the upper conductive layer 102 through which the surge voltage flows and the second lower conductive layer 105 which connects to the power supply potential. Therefore, a penetration part 107 in the upper conductive layer 102 is provided on the upper side of the second through hole 1003*a*, so that with the structure, the second lower conductive layer 105 (the third conductive layer) and the upper conductive layer 102 (the first conductive layer are in no part laminated sandwiching the second insulation layer 115. With this structure, a large potential difference is not generated at the area near the second through hole 1003*a*, where the thickness of the second insulation layer 115 becomes comparatively thin, so that the dielectric breakdown of the second insulation layer 115 can be prevented.

More concretely, in a direction parallel to the surface of the substrate, it is useful to provide a distance Z between the through hole 107 in the upper conductive layer and the end part of the first insulation layer 114 which is at least equal to or more than 2 μm apart. By causing the distance Z to be equal to or more than 2 μm apart, the dielectric breakdown of the second insulation layer 115 at the part of the second through hole 1003*a* can be more certainly prevented.

With this structure, the liquid discharge head having high reliability, in which the inverter circuit 301 and the second insulation layer 115 is not dielectric-broken when static electricity discharge is generated, can be provided.

Figure 5A:
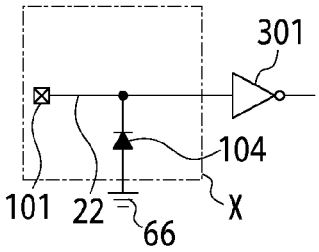
FIGS. 5A through 5C illustrate a static electricity protection element.

Next, a second exemplary embodiment will be described. FIG. 5A is a block diagram illustrating a liquid discharge head, in which a second protection diode 104 can pass a surge current to a wiring connecting to the substrate potential when the static electricity surge is applied. A cathode (one of the electrodes) of the second protection diode 104 is connected to the. The first wiring 22 connects the terminal 101 for electrically connecting to the external, to the inverter circuit 301 provided in the input circuit 95. An anode (the other electrode) of the second protection diode 104 is connected to a third wiring 66 connecting to the substrate potential.

With this structure, even when the surge by the static electricity discharge having a lower potential than the substrate potential is applied from the terminal 101, the surge current flows from the terminal 101 to the third wiring 66 via the second protection diode 104. More specifically, the surge current flows from the cathode of the second protection diode 104 to the anode, and further flows to the third wiring 66. Therefore, the dielectric breakdown of the inverter circuit 301 can be prevented.

Figure 5B:
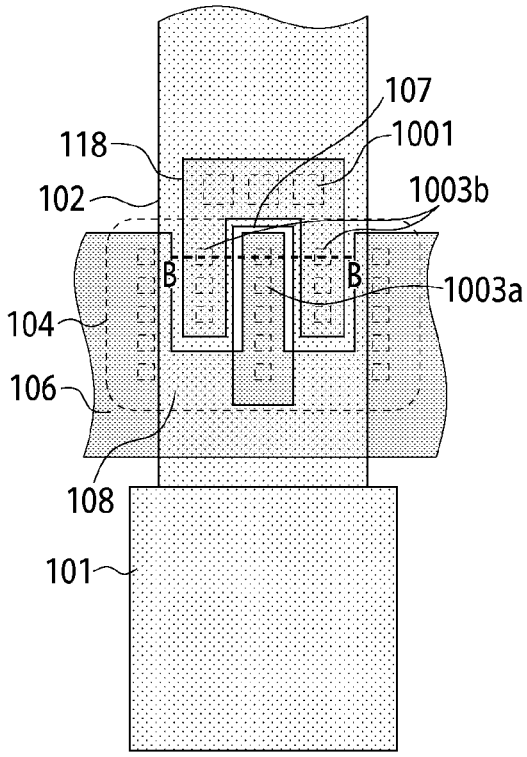
Figure 5C:
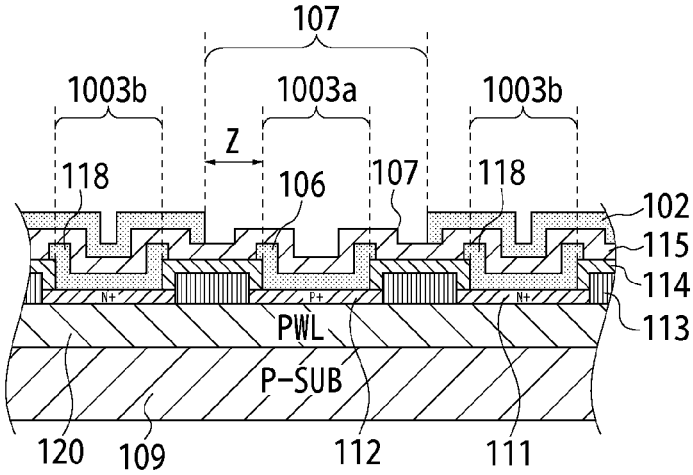

FIG. 5B is a top view of an X part in FIG. 5A. FIG. 5C is a cross-sectional view of a B-B line in FIG. 5B. On the substrate 109, the lower conductive layer and the upper conductive layer are laminated and provided sandwiching the second insulation layer 115. In an inside of the surface of the p-type silicon substrate 109, the second protection diode 104 including a p-type well region 120, a n-type (n+) impurity diffusion region 111, and a p-type (p+) impurity diffusion region 112 is provided. Further, the thermally-oxidized layer 113 is provided between the n-type (n+) impurity diffusion region 111 and the p-type (p+) impurity diffusion region 112, and performs the element separation of the n-type (n+) impurity diffusion region 111 and the p-type (p+) impurity diffusion region 112. Furthermore, on the thermally-oxidized layer 113, the first insulation layer 114 made of BPSG is provided.

In the first insulation layer 114, a first through hole 1003*b* (a first penetration part) is provided and the n+ impurity diffusion region 111 and the first lower conductive layer 118 (the second conductive layer) which is a part of the lower conductive layer are connected to each other. Further, in the second through hole 1003*a* (a second penetration part) of the first insulation layer 114, the p+ impurity diffusion region 112 and the second lower conductive layer 106 (the third conductive layer), which is another part of the lower conductive layer, are connected to each other. As described above, one pair of the lower conductive layers (the second conductive layer and the third conductive layer) are provided so as to respectively connect to the impurity diffusion regions of the second protection diode 104.

The upper conductive layer 102 (the first conductive layer) is connected to the terminal 101 electrically connecting to the external. In the second insulation layer 115 made of SiO, the through hole 1001 is provided and the first lower conductive layer 118 and the upper conductive layer 102 are connected via the through hole 1001 so as to be at an equal potential and the first wiring 22 is provided. The second lower conductive layer 106 which forms the third wiring 66 is connected to the substrate potential.

In an area in which the through hole 1003 is provided, as illustrated in FIG. 5C, the through hole is formed in the thermally-oxidized layer 113 and the first insulation layer 114, a step height of the second insulation layer 115 is larger in comparison with the other areas, and the dielectric breakdown can be generated when a high potential difference is applied.

In this structure, the first lower conductive layer 118 is connected to the upper conductive layer 102 by the through hole 1001 provided in the second insulation layer 115, so that the upper conductive layer 102 and the lower conductive layer 118 are at an equal potential even when the surge is applied. Therefore, although the first lower conductive layer 118 (the second conductive layer) and the upper conductive layer 102 (the first conductive layer) are laminated sandwiching the second insulation layer 115, there is low possibility of the dielectric breakdown of the second insulation layer 115. On the other hand, in the second through hole 1003*a*, if the upper conductive layer 102 is provided on the second insulation layer 115, a large potential difference is generated between the upper conductive layer 102 which is at the surge potential and the second lower conductive layer 106 connecting to the power supply potential. Therefore, a penetration part 107 in the upper conductive layer 102 is provided on the upper side of the second through hole 1003*a*, so that the second lower conductive layer 106 (the third conductive layer) and the upper conductive layer 102 (the first conductive layer) are in no part laminated sandwiching the second insulation layer 115. With this structure, a large potential difference is not generated at the part near the second through hole 1003*a* in which the thickness of the second insulation layer 115 becomes thin, so that the dielectric breakdown of the second insulation layer 115 can be prevented.

More concretely, in the direction parallel to the surface of the substrate it is useful that a distance Z between the end of the upper conductive layer 102 and the through hole of the first insulation layer 114 is at least equal to or more than 2 μm apart. With the distance Z at least equal to or more than 2 μm, the dielectric breakdown of the second insulation layer 115 at the second through hole 1003*a* part can be prevented.

With this structure, a high reliability liquid discharge head can be provided, in which the dielectric breakdown of the inverter circuit 301 and the second insulation layer 115 is not generated when the static electricity discharge occurs.

Figure 6A:
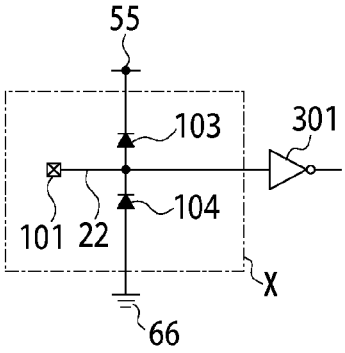
FIGS. 6A through 6D illustrate a static electricity protection element.

Next, a third exemplary embodiment will be described. FIG. 6A is a block diagram of a liquid discharge head including the first protection diode 103 and the second protection diode 104. The first protection diode 103 described in the first exemplary embodiment can pass the surge current to the power supply potential. The second protection diode 104 described in the second exemplary embodiment can pass the surge current to the substrate potential.

The anode of the first protection diode 103 and the cathode of the second protection diode 104 are connected to the first wiring 22 which connects the terminal 101 to the inverter circuit 301. The first protection diode 103 connects to the power supply potential and the second protection diode 104 connects to the substrate potential. The cathode of the first protection diode 103 is connected to the second wiring 55 of the lower conductive layer, which is connected to the power supply potential. The anode of the second protection diode 104 is connected to the third wiring 66, which is configured by the lower conductive layer and connected to the substrate potential.

With this structure, when the surge by the static electricity discharge having a higher potential than the power supply potential is applied from the terminal 101, the surge current flows to the second wiring 55 via the first protection diode 103. Further, when the surge by the static electricity discharge having a lower potential than the substrate potential is applied from the terminal 101, the surge current flows from the terminal 101 to the third wiring 66 via the second protection diode 104. Therefore, even when any surges by the static electricity is applied from the terminal 101, the breakdown of the inverter circuit 301 can be prevented.

Figure 6B:
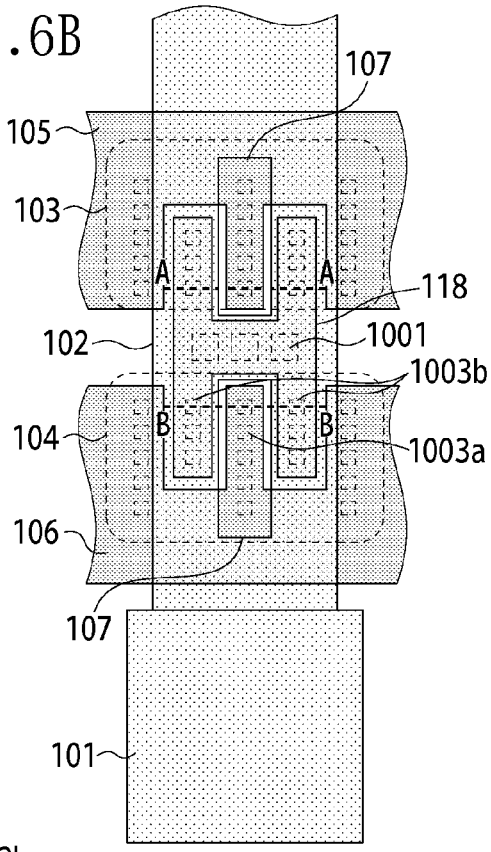
Figure 6C:
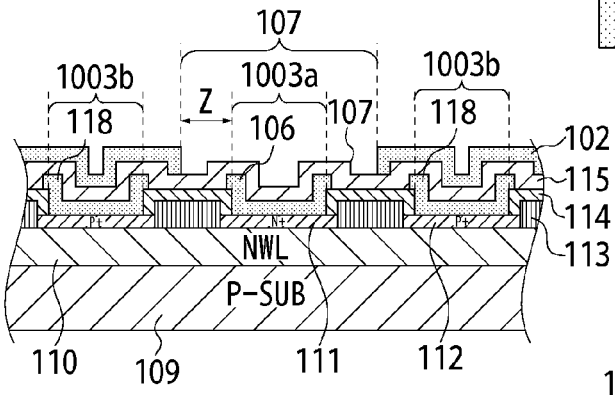
Figure 6D:
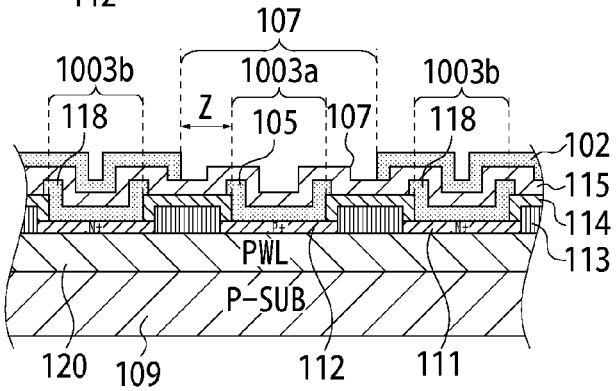

FIG. 6B illustrates a top view of a X part in FIG. 6A. FIG. 6C illustrates a cross-sectional view of a A-A line in FIG. 6B. FIG. 6D illustrates a cross-sectional view of a B-B line in FIG. 6B. The configuration of the first protection diode 103 is same as the first exemplary embodiment, and the configuration of the second protection diode 104 is same as the second exemplary embodiment, so that the description will be omitted.

Figure 7A:
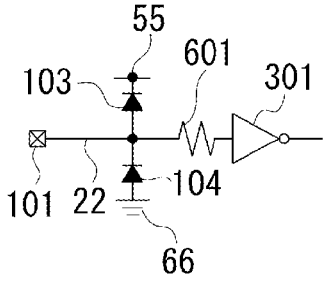
FIGS. 7A through 7D are an example of a block diagram of the static electricity protection element which can use the exemplary embodiment of the present invention.

In addition, as illustrated in FIG. 7A, a resistor 601 is provided between a part, in which the first protection diode 103 and the second protection diode 104 are provided, and the inverter circuit 301, so that the potential of the surge which is not absorbed by the protection diode can be lowered. As the resistor 601, a thin film resistor made of polycrystalline silicon or a metal compound, or a diffusion resistor made by doping impurities to a semiconductor can be used.

Figure 7B:
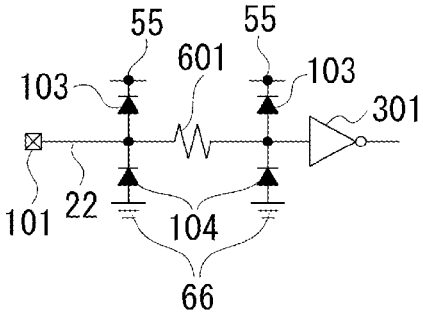
Figure 7C:
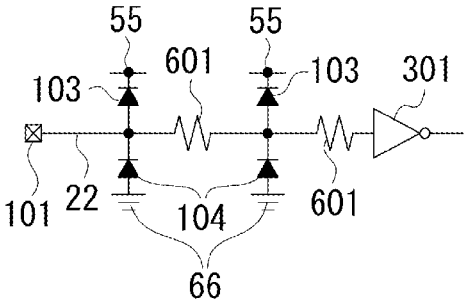

Further, as illustrated in FIG. 7B and FIG. 7C, a plurality of the first protection diodes 103 and the second protection diodes 104 and a plurality of the resistors 601 can be provided. With this structure, the dielectric breakdown by the static electricity discharge can be more certainly prevented.

Figure 7D:
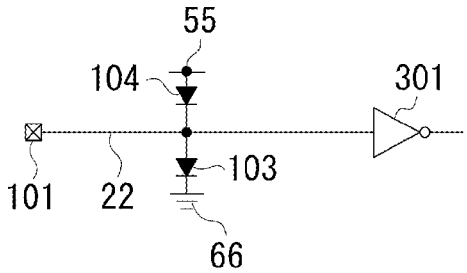
Figure 8A:
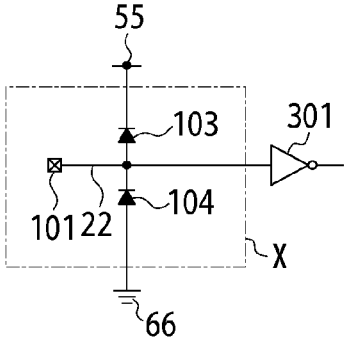
FIG.8A PRIOR ART
FIGS. 8A through 8D illustrate a conventional static electricity protection element.
Figure 8B:
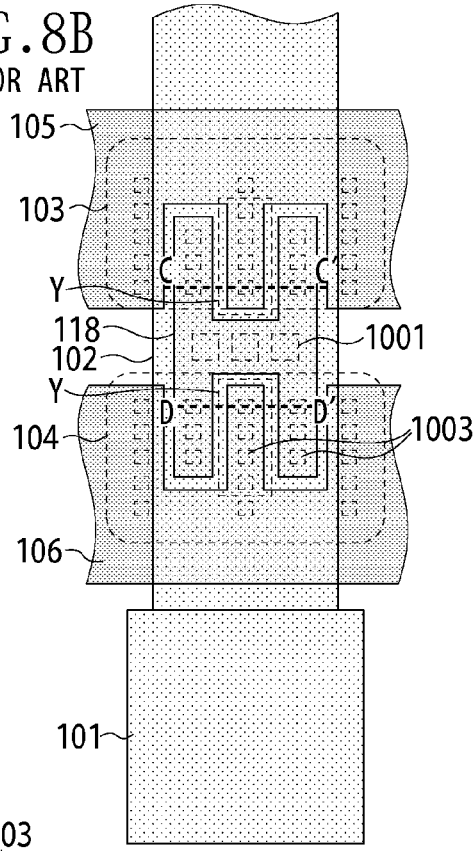
FIG.8B PRIOR ART
Figure 8C:
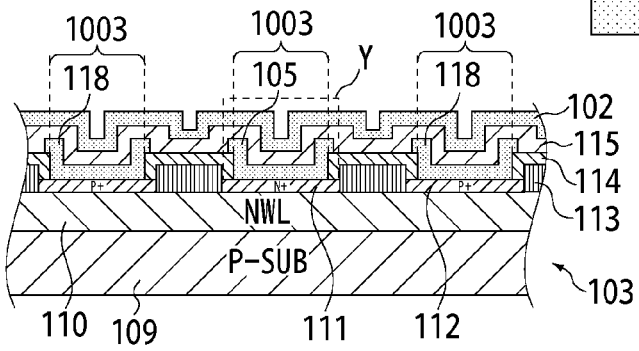
FIG.8C PRIOR ART
Figure 8D:
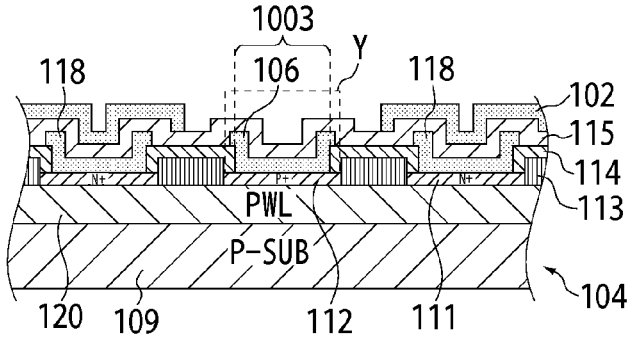
FIG.8D PRIOR ART

In the exemplary embodiments from the first to the third, the example in which the power supply potential is higher than the substrate potential is used for description. However, when the power supply potential is lower than the substrate potential, as illustrated in FIG. 7D, the first protection diode 103 is provided on the substrate potential side and the second protection diode 104 is provide on the power supply potential side, so that the same effect can be obtained. In this case, the cathode of the second protection diode 104 connected to the power supply potential and the anode of the first protection diode 103 connected to the substrate potential are connected to the upper conductive layer 102. The upper conductive layer 102 is connected the terminal 101 and the inverter circuit 301. With this structure, when the potential of the static electricity discharge is higher than the substrate potential, the surge current flows to the first protection diode 103. On the other hand, when the potential of the static electricity discharge is lower than the power supply potential, the surge current flows to the second protection diode 104. With this structure, even when the static electricity discharge occurs, the dielectric breakdown of the inverter circuit 301 can be prevented.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2010-054719 filed Mar. 11, 2010, which is hereby incorporated by reference herein in its entirety.

What is claimed is:

1. A liquid discharge head substrate comprising:

an external terminal configured to connect to an external;

a first conductive layer connected to the external terminal for causing a current input from the external terminal to flow, and a diode comprising an anode and a cathode;

a second conductive layer connected to the first conductive layer and one electrode of the anode and the cathode, which causes a surge current generated when a surge voltage is applied from the external terminal, to flow from the first conductive layer to the one electrode; and a third conductive layer connected to the other electrode of the anode and the cathode, which passes the surge current flowing from the one electrode to the other electrode;

wherein the first conductive layer comprises a part laminating with the second conductive layer sandwiching an insulation layer and does not comprise a part laminating with the third conductive layer.

2. The liquid discharge head substrate according to claim 1, wherein the third conductive layer is connected to a power supply potential or a substrate potential.

3. The liquid discharge head substrate according to claim 1, wherein the external terminal is used for inputting a logic signal to perform a drive control of an energy generating element used for generating an energy to discharge a liquid.

4. The liquid discharge head substrate according to claim 1, wherein the diode is provided on the surface of a substrate, and on the upper side of the surface, the second conductive layer, the insulation layer, and the first conductive layer are provided in this order, and wherein the third conductive layer is positioned between the surface and the insulation layer.

5. The liquid discharge head substrate according to claim 1, wherein the insulation layer is made of a material containing silicon.

6. The liquid discharge head substrate according to claim 1, wherein the first conductive layer, the second conductive layer, and the third conductive layer are made of aluminum.

7. A head unit detachable from a discharge apparatus comprising:

a liquid discharge head substrate according to claim 1; and a contact pad having conduction to the external terminal of the liquid discharge head substrate.

8. The head unit according to claim 7, wherein the contact pad is provided on an outer surface of the head unit.

* * * * *